US011266875B2

(12) United States Patent
Fowler

(10) Patent No.: US 11,266,875 B2
(45) Date of Patent: Mar. 8, 2022

(54) SPACE-SAVING EXERCISE EQUIPMENT

(71) Applicant: David Alexander Fowler, Nottingham (GB)

(72) Inventor: David Alexander Fowler, Nottingham (GB)

( * ) Notice: Subject to any disclaimer, the term of this patent is extended or adjusted under 35 U.S.C. 154(b) by 98 days.

(21) Appl. No.: 16/818,367

(22) Filed: Mar. 13, 2020

(65) Prior Publication Data

US 2020/0215385 A1 Jul. 9, 2020

Related U.S. Application Data

(63) Continuation of application No. 15/550,232, filed as application No. PCT/GB2016/050402 on Feb. 18, 2016, now abandoned.

(30) Foreign Application Priority Data

Feb. 18, 2015 (GB) ..... 1502752
Jun. 3, 2015 (GB) ..... 1509672
Nov. 11, 2015 (GB) ..... 1519924

(51) Int. Cl.
*A63B 23/035* (2006.01)
*A63B 21/02* (2006.01)
(Continued)

(52) U.S. Cl.
CPC .. *A63B 23/03566* (2013.01); *A63B 21/00192* (2013.01); *A63B 21/02* (2013.01);
(Continued)

(58) Field of Classification Search
CPC ..... A63B 23/03566; A63B 21/4043; A63B 71/04; A63B 21/4034; A63B 21/00192;
(Continued)

(56) References Cited

U.S. PATENT DOCUMENTS 332,989 A * 12/1885 Benedict ..... A63B 21/0628 482/102
457,400 A 8/1891 Dowd
(Continued)

FOREIGN PATENT DOCUMENTS

EP 1790389 5/2007
FR 2480608 10/1981
(Continued)

OTHER PUBLICATIONS

International Search Report and Written Opinion, International Application PCT/GB2016/050402, International Filing date Feb. 18, 2016, dated May 18, 2016.
(Continued)

*Primary Examiner* — Garrett K Atkinson
(74) *Attorney, Agent, or Firm* — Bond Schoeneck & King, PLLC; Joseph M. Noto

(57) ABSTRACT

The invention concerns exercise apparatus having a weight source (18) operably connected to a plurality of manual actuators (28, 32) by a cable and pulley system. The cable and pulley system (12) has a plurality of pulley wheels (16), a supporting frame (10) for the weight source (18) and pulley wheels (16), and a cable (22) defining a force path from the weight source (18) over the pulley wheels (16). The pulley wheels (16) and frame (10) are provided in a common plane with the weight source (18) at least when the exercise apparatus is not in use. The manual actuators (28, 32) are provided at spaced locations along the path defined by the cable (22) and are actuatable in a direction away from the common plane when in use. The frame (10) may supported in an upright orientation for use by a support structure, e.g. a wall, and may occupy a minimal space/depth.

22 Claims, 3 Drawing Sheets

Figure 1:
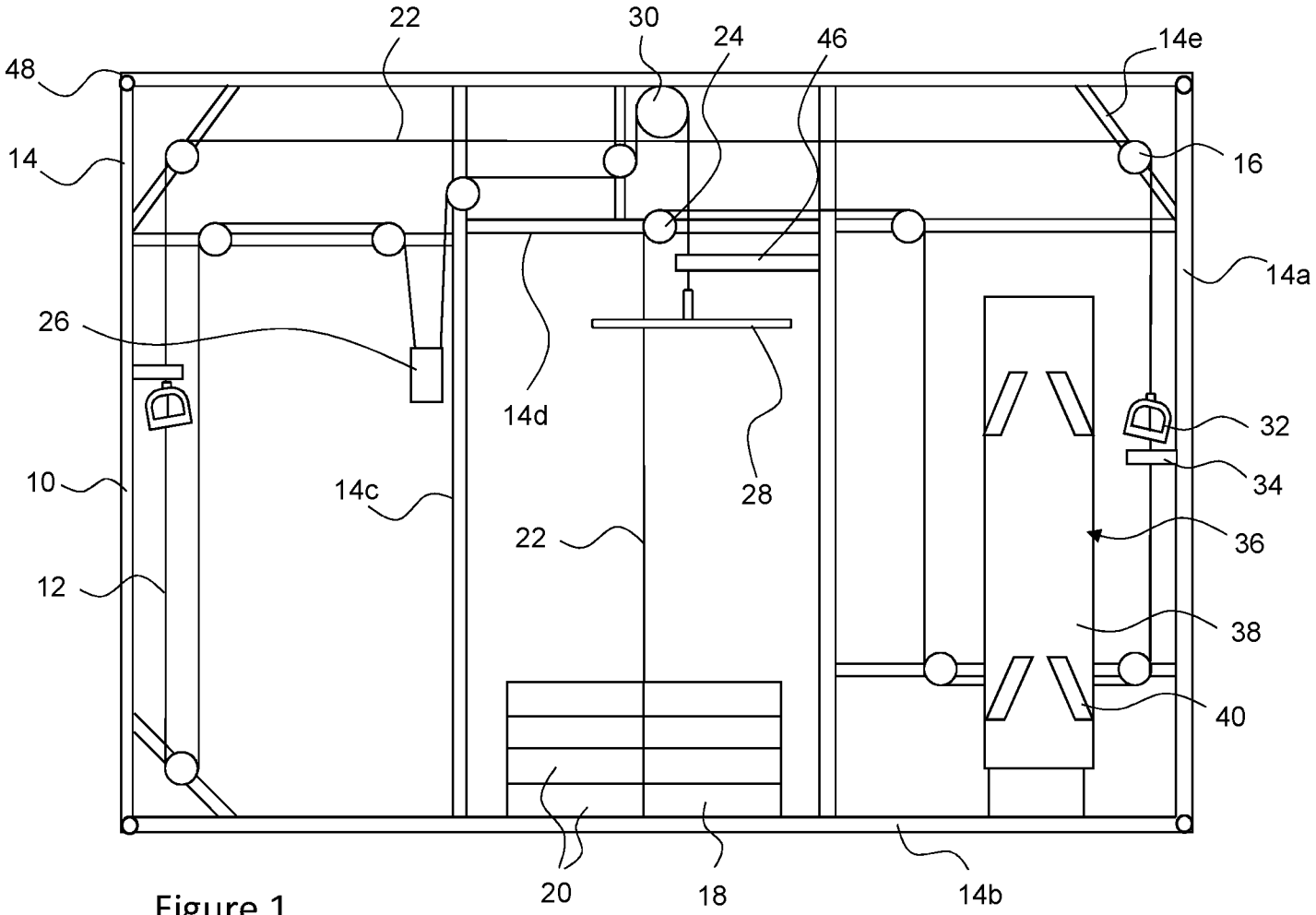

(51) Int. Cl.

| | |
|---|---|
| ***A63B 21/00*** | (2006.01) |
| ***A63B 22/00*** | (2006.01) |
| ***A63B 21/062*** | (2006.01) |
| ***A63B 71/04*** | (2006.01) |
| ***A63B 21/16*** | (2006.01) |
| ***A63B 71/02*** | (2006.01) |

(52) U.S. Cl.

CPC ..... *A63B 21/0628* (2015.10); *A63B 21/154* (2013.01); *A63B 21/4034* (2015.10); *A63B 21/4035* (2015.10); *A63B 21/4043* (2015.10); *A63B 22/0076* (2013.01); *A63B 23/03525* (2013.01); *A63B 71/04* (2013.01); *A63B 21/169* (2015.10); *A63B 22/0048* (2013.01); *A63B 22/0087* (2013.01); *A63B 2022/0079* (2013.01); *A63B 2071/024* (2013.01); *A63B 2210/06* (2013.01); *A63B 2210/50* (2013.01)

(58) Field of Classification Search

CPC . A63B 23/03525; A63B 21/02; A63B 21/154; A63B 22/0076; A63B 21/4035; A63B 21/0628; A63B 2210/06; A63B 21/169; A63B 2071/024; A63B 22/0048; A63B 22/0087; A63B 2022/0079; A63B 2210/50; A63B 22/0056; A63B 21/156; A63B 21/1672; A63B 21/4029; A63B 21/151; A63B 2210/00

See application file for complete search history.

(56) References Cited

U.S. PATENT DOCUMENTS

| | | | | | |
|---|---|---|---|---|---|
| 475,400 | A * | 5/1892 | Houghton et al. | A44C 25/002 | 40/660 |
| 3,746,338 | A * | 7/1973 | Proctor | A63B 21/4045 | 482/101 |
| 3,840,227 | A * | 10/1974 | Chesemore | A63B 21/0628 | 482/102 |
| 3,874,657 | A * | 4/1975 | Niebojewski | A63B 22/0002 | 482/104 |
| 4,257,590 | A * | 3/1981 | Sullivan | A63B 21/154 | 482/133 |
| 4,685,670 | A * | 8/1987 | Zinkin | A63B 21/1681 | 482/129 |
| 4,856,773 | A * | 8/1989 | Deola | A63B 21/063 | 482/102 |
| 4,898,381 | A * | 2/1990 | Gordon | A63B 21/00072 | 482/103 |
| 4,974,836 | A * | 12/1990 | Hirsch | A63B 21/06 | 473/451 |
| 4,976,428 | A * | 12/1990 | Ghazi | A63B 23/03575 | 482/112 |
| 5,050,869 | A * | 9/1991 | Frate | A63B 21/154 | 482/94 |
| 5,072,934 | A * | 12/1991 | Blanes | A63B 21/1627 | 482/94 |
| 5,184,992 | A * | 2/1993 | Banks | A63B 21/06 | 482/104 |
| 5,267,930 | A * | 12/1993 | Henes | A63B 21/154 | 482/139 |
| 6,080,091 | A * | 6/2000 | Habing | A63B 23/12 | 482/100 |
| 6,579,213 | B1 * | 6/2003 | Webber | A63B 21/155 | 482/100 |
| 7,575,538 | B1 * | 8/2009 | Clark | A63B 23/1263 | 482/103 |
| 7,837,602 | B1 * | 11/2010 | Drybread | A63B 23/12 | 482/102 |
| 8,986,166 | B2 * | 3/2015 | Nishimura | A63B 21/063 | 482/5 |
| 9,132,330 | B2 * | 9/2015 | Brendle | A63B 21/169 | |
| 9,427,619 | B2 * | 8/2016 | Franks | A63B 21/0552 | |
| 2002/0091043 | A1 * | 7/2002 | Rexach | A63B 21/0626 | 482/98 |
| 2006/0264305 | A1 * | 11/2006 | Klassen | A63B 21/4019 | 482/99 |
| 2008/0015095 | A1 * | 1/2008 | Savsek | A63B 22/0076 | 482/121 |
| 2009/0181833 | A1 * | 7/2009 | Cassidy | A63B 21/156 | 482/94 |
| 2011/0237405 | A1 * | 9/2011 | Reyes | A63B 21/4035 | 482/94 |
| 2011/0319230 | A1 * | 12/2011 | Brendle | A63B 69/0048 | 482/37 |
| 2012/0100961 | A1 * | 4/2012 | Nishimura | A63B 21/0628 | 482/5 |
| 2012/0142503 | A1 * | 6/2012 | Sevadjian | A63B 23/1254 | 482/99 |
| 2013/0090216 | A1 * | 4/2013 | Jackson | A63B 21/154 | 482/52 |
| 2013/0267392 | A1 * | 10/2013 | Miranda | A63B 21/06 | 482/102 |
| 2013/0274074 | A1 * | 10/2013 | Ghandour | A63B 21/4035 | 482/93 |
| 2013/0288861 | A1 * | 10/2013 | Cole | A63B 23/1263 | 482/102 |
| 2015/0087486 | A1 * | 3/2015 | Franks | A63B 21/0552 | 482/129 |
| 2017/0056705 | A1 * | 3/2017 | Zha | A63B 23/03558 | |

FOREIGN PATENT DOCUMENTS

| | | |
|---|---|---|
| GB | 307116 | 3/1929 |
| GB | 2268086 | 6/1992 |
| WO | 2008050330 | 5/2008 |
| WO | 2009003280 | 1/2009 |
| WO | 2015196158 | 12/2015 |
| WO | 2016132132 | 8/2016 |

OTHER PUBLICATIONS

Combined Search & Exam Report. UKIPO. GBC Application No. GB1519924.3, pp. 1-9, dated Jul. 27, 2016.

EPO Communication dated Sep. 24, 2019 for EP Application No. 16706408.8.

* cited by examiner

SPACE-SAVING EXERCISE EQUIPMENT

CROSS REFERENCE

This application is a continuation of co-pending U.S. Non-Provisional application Ser. No. 15/550,232 filed Aug. 10, 2017, which is a U.S. National Stage application of International Application No. PCT/GB2016/050402 filed on Feb. 18, 2016, which claims the benefit of the filing date of Great Britain Application Nos. 1502752.7, filed Feb. 18, 2015, 1509672.0, filed Jun. 3, 2015, and 1519924.3, filed Nov. 11, 2015, each of which is hereby incorporated by reference in its entirety.

The present invention relates to exercise equipment, and in particular to home exercise equipment, such as, for example, resistance weight machines.

Many people take part in weight training or aerobic exercise in order to improve fitness, increase strength and improve muscle tone. People may choose to exercise at a public gym or health club, or alternatively may choose to install gym equipment within their own property. Owning home gym equipment may be preferable for many people as it provides the user with the convenience of exercising at home, thereby avoiding the cost, travel and social implications of exercising at a communal gym.

A disadvantage associated with conventional home gym equipment is its size. For example, a bench press, a rowing machine or a chest press require a large amount of floor space. In order for a personal home gym to comprise a sufficient variety of equipment, it is often required that an entire room in a person's house is dedicated to being a home gym. Even then, the average garage or spare room within a typical home is often not large enough to safely house a wide variety of exercise machines.

In an attempt to overcome the problem of the large amount of room and floor space required for a home gym comprising a large variety of gym equipment, so-called multi-gyms have become well known in the prior art. Multi-gyms generally provide a variety of weight resistance apparatus in one single machine. However, multi-gyms themselves are large and generally take up a significant amount of floor space and room, typically approximately two to three cubic metres or more. This is at least in part due to the need for a multi-gym to accommodate a weight stack safely, thereby requiring a frame with sufficient spacing between its feet so as to be stable. The spacing between the feet causes conventional multi-gyms to have a large footprint, thereby eating into the available floor space within a room.

Multi-gyms are commonly designed for a user to move around different pieces of equipment in a circle or circuit, performing different exercises at the different pieces of equipment. This necessitates a circular or curved floor plan, which therefore results in unused space in a typical rectangular room with planar walls.

Furthermore, whilst it has been proposed that a more limited number of very specific exercises may be performed in a relatively smaller space, the limiting of multi-gyms to a specific few exercises only detracts from its value and appeal to the end user.

If a multi-gym is intended to accommodate various seated or reclining exercise positions then this typically incurs a significant spatial penalty.

It is an object of the present invention to provide exercise apparatus that overcomes one or more disadvantage of conventional home gym equipment. It may be considered an additional or alternative aim to provide resistance weight equipment offering a relatively small form factor, whilst providing the opportunity for the user to undertake a variety of different exercises.

According to a first aspect of the invention there is provided exercise apparatus comprising a weight source operably connected to a plurality of manual actuators by a cable and pulley system comprising a plurality of pulley wheels, a supporting frame for the weight source and pulley wheels, and a cable defining a force path from the weight source over the pulley wheels, wherein the pulley wheels and frame are provided in a common plane with the weight source when the exercise apparatus is not in use, and the manual actuators are connected at fixed spaced locations along the path defined by the cable length and are actuatable in a direction away from the common plane when in use, wherein the frame is supported in an upright orientation for use by a support structure.

The weight source may thus be actuated by the cable and pulley system in a direction within the common plane during use, e.g. within a vertical plane. This, in combination with the support by a support structure, allows the exercise apparatus to be accommodated in a very small depth, such that it can stand flat against the support structure.

The support structure may comprise a planar support structure, such as a wall. Additionally or alternatively, the support structure may comprise a generally horizontal support structure, such as a floor or a base. The frame may be attached to the support structure by one or more fasteners, such as bolts or the like.

The frame may comprise a two-dimensional frame structure. The frame may comprise one or more frame member extending in a direction within the common plane. Typically the frame member comprises or consists of a plurality of frame members, all of which extend in directions within the common plane. The frame may comprise a plurality of angled frame members, e.g. perpendicular frame members. The plurality of frame members may be rigidly/permanently affixed within the planar alignment. The entire frame may be aligned with the common plane, e.g. at least in a storage condition.

The exercise apparatus including the frame, weight stack and pulley wheel according to the invention may be beneficially thin in profile, e.g. having a depth dimension of less than 500 mm. The depth may be less than 400 mm, 300 mm or even less than 200 mm, e.g. in the region of, or less than, 150 mm or 100 mm. A range of 50-200 mm depth or 80-100 mm is entirely practical using the present invention. Thus the distance by which the exercise equipment protrudes into a room, at least when not in use, from a suitable supporting structure, such as a wall, is beneficially small.

The invention may allow exercise equipment to be installed in rooms without occupying a detrimental volume of the room, e.g. allowing the room to provide an additional function other than being purely used as an exercise room.

The weight source may be variable. For example, the weight source may comprise a stack of weights, and a user may select a desired weight from the weight source, e.g. by selecting the number of weights or the height of the stack to be lifted by the cable. Actuation of the manual actuator typically applies tension to the cable in a direction so as to oppose the direction of applied weight by the weight source, i.e. to lift the weight source in use. A common/single weight source may be provided for all the actuators, e.g. connected thereto by a common cable.

A plurality of types of manual actuator may be provided.

The weight source may be a common weight source. Each actuator may be individually or collectively connected to the weight source, e.g. in series or parallel. A plurality of manual actuators may be connected at differing lengths/locations along the cable, e.g. at different cable length spacing from the weight source. Different/adjacent manual actuators may be spaced by one or more pulley wheel. This may allow each manual actuator to apply tension to the cable in a different direction or orientation or at a different height from one or more further manual actuator.

The equipment may comprise three or four or five or more manual actuators and/or pulley wheels. The exercise equipment may comprise a variety of manual actuator types, such as any combination of one or more bar, one or more handle, one or more strap or the like. The manual actuators may be connectable to the pulley system at various locations on the pulley system. Multiple actuators may be attachable to a single/common cable of the pulley system. The manual actuators may be releasably connectable to the cable, e.g. in order that a user may selectively add/remove actuators or change the position of the actuators on the cable.

The cable may comprise a plurality of manual actuator connection locations or formations along its length. The connection formations may or may not comprise any of eyes, links, clips, loops or the like. The connection locations may allow bifurcation of the cable, i.e. a common cable section connecting to the weight source, for example by providing one or more junction to a branching cable section.

Any, any combination, or all of the manual actuators may be directly/indirectly attached to a fixed point on the cable Any, any combination, or all of the manual actuators may be connected to a branching cable section, e.g. midway along its length or at an end thereof. A branching cable section may be connected to the common cable section at one end and to any of a manual actuator, a location on the frame or a hanging counterweight at an opposing end. A branching cable section may be connected to an anchor/fastener location on the frame at its opposing end, either directly or via an intervening length of connecting cable, chain, cord of the like.

One or more branching cable section may pass around a corresponding/branching pulley. The manual actuator may be connected upstream or downstream of the pulley in the direction of applied tension. Such a pulley may be advantageous in controlling motion of the branching cable section and/or ensuring that a sufficient length of branching cable is available for a full range of manual actuation. A branching pulley wheel may be off-set, e.g. angularly, from the plurality of pulley wheel, e.g. in order to accommodate for the cable to be pulled in a direction that is out of the common plane of the frame and weight source in use.

The exercise equipment may comprise a single/common cable or cable portion. Alternatively the exercise equipment may comprise two or more cables or cable portions. The two or more cables may be operably connected to the weight source. A common cable portion may or may not bifurcate into two or more branching/parallel cable sections. The exercise equipment may comprise two or more weight sources and the two or more cables or cable sections may be connected to different weight sources.

The cable may comprise or consist of a cord. The cable may comprise or consist of a chain.

The/each pulley wheel typically comprises a wheel mounted to a static support structure via bearings. The at least one pulley wheel may be a conventional pulley wheel. Alternatively where the cable comprises a chain, the at least one pulley wheel may be a sprocket wheel.

A first pulley wheel may be the first point of contact for the cable that extends from the weight source, thereby being the closest pulley wheel in the force path of the cable from the weight source. A second pulley wheel is spaced from the first pulley wheel and the weight source, such that it is the second pulley wheel in the force path of the cable from the weight source. The second pulley wheel and/or a subsequent pulley wheel may be off-set, e.g. angularly, from the first pulley wheel in use, e.g. in order to accommodate for the cable to be pulled in a direction that is out of the common plane of the frame and weight source in use.

At least four or five pulleys may be provided for the common cable section. At least two or more pulleys may be provided on the frame for branching cable sections.

The cable may extend around the first pulley wheel towards a second and/or subsequent pulley wheels so as to define a cable circuit, e.g. an open-ended circuit, follows the force path from the weight stack to an opposing end of the cable. The pulley wheel(s) may comprise one or more cable guide(s).

A first end of the cable may be attached to the weight source. An opposing end of the cable may be attached to a manual actuator.

One or more cable guide, e.g. a linear cable guide, may be provided, e.g. separately from the one or more pulley. The cable guide may comprise a runner or slider attached to a point on the cable, e.g. an intermediate portion of the cable spaced from the cable ends, such as on the common cable section and/or a branching cable section. The runner may be attached to, or constrained by, a linear guide, such as a slot or track.

In any cable guide example, the cable guides may prevent the cable from twisting, jumping or snagging, e.g. during tensioning and release of the cable in use.

Additionally or alternatively, one or more swivel connector may be provided in the cable and pulley system to prevent twisting of the cable, e.g. part-way along the cable length. Adjacent cable sections may be connected by swivel connectors, e.g. at locations between adjacent pulley wheels. A swivel connector may be provided at the junction between the common cable and one or more branch sections.

A plurality of the pulley wheel(s) may have an axis of rotation this is substantially perpendicular to the common plane. A pulley wheel that is adjacent a manual actuator may be angularly offset from one or more further pulley wheel in use.

The at least one pulley wheel may be rotatable around an axis that is in the common plane, in order that the pulley wheel may rotate out of the common plane. The at least one pulley wheel may be rotatable through use of a hinge or swivel. The at least one pulley wheel may be in the common plane in use. Alternatively, the at least one pulley wheel may be rotated around the axis such that the pulley wheel is out of the common plane in use. The pulley wheel being rotatable such that it may be rotated out of the common frame is advantageous as it allows a user to move the manual actuator in use in a direction that is out of the common plane of the frame.

There may be provided cable guides on the frame, for example hooks, or eyes which may extend at least partially around the cable. The cable guides may provide a location around which the cable may bend when a user pulls on an actuator, thereby providing the location from which the cable, e.g. a branching portion thereof, is pulled out of the common plane of the frame and weights source. The position of the hooks relative to the frame may be variable, in order that a user may pull the cable from different locations of the pulley system to carry out different exercises. Additionally or alternatively, the cable guides may serve to maintain the correct orientation of the cable within the common plane, e.g. adjacent a pulley wheel or part/mid way between spaced pulley wheels.

The manual actuator may comprise a bar, e.g. having two spaced handle/grip portions, or a single handle, stirrup or a pair of handles/stirrups connected to a common location on the cable. The manual actuator may comprise a liner actuator or a pivoting/rotating actuator. The actuator may comprise a mechanism, such as a lever.

In use, a user may pull the manual actuator in a direction that is in the common plane or out of the common plane. Pulling the manual actuator may cause the weight source to be lifted in an upwards direction. Releasing the manual actuator may cause the weight source to move vertically downwards to its original position.

One manual actuator may comprise a rowing action actuator. One manual actuator may comprise a pulldown bar or T-bar.

The pulley system may comprise one or more counterweight. A counter weight may be located within the frame, e.g. within the common plane and may serve to maintain a desired tension in the cable, e.g. to dampen cable motion. One or more of the multiple manual actuators attached to the single cable of the pulley system may act as counterweights. One of the multiple manual actuators may act as a counterweight when that actuator is attached to the pulley system but that actuator is not in use for a particular exercise being carried out on the exercise equipment. The actuators may therefore comprise a weight source suitable to act as a counter weight. The swivels may or may not act as counterweights. The counterweights may ensure that there is sufficient tension in the cable when the exercise equipment is in use in order that the cable is not loose and does not twist, loop or tangle, either under load or when the load is released and the cable returns to its original position.

In some embodiments, the pulley system and frame may be fixed. In other embodiments, at least part of the pulley system and/or frame may be movable relative to the remainder of the pulley system and or frame. When the exercise equipment is not in use, for example in a storage condition, the frame and pulley system may be arranged such that the frame, pulley system and weight source are in a common plane. In use, portions of the pulley system and/or frame may rotate or fold out of the common plane of the weight source and the remainder of the pulley system and frame. Only one or more selected portions of the frame and/or pulley system may be rotated or folded out of the plane of the common plane; the remainder of the frame and pulley system may be fixed relative to the support structure. In a usage condition, at rest a majority of the cable and pulley system may remain oriented in the common plane.

The exercise equipment may comprise a seat that folds out from the frame. The seat may be a sliding seat, for example the seat of a rowing machine. The seat may be fixed or lockable and may be for the user to sit when undertaking certain weight exercises. The seat may comprise one or more leg, e.g. a foldable leg, to support the seat on the ground when in use.

The exercise equipment may be embedded/mounted within the surface of a wall or affixed against an interior or exterior wall surface of a building. The wall or wall surface may provide a planar support structure.

The exercise equipment may comprise a cover, for example a blind or removable panel, such that it is hidden from view when not in use.

In examples of the invention wherein the exercise equipment is mounted in a wall cavity, there may be provided openings in the wall surface wherein actuators may be attached to the pulley system. Alternatively, openings may be provided in a panel that covers the exercise equipment, through which actuators may be attached to the pulley system.

The exercise equipment may comprise further exercise apparatus that may be attached to the frame, but not part of the pulley system. For example, the exercise equipment may comprise a stepper/treadle that may fold out of the frame. The further exercise apparatus that may be attached to the frame but not form part of the pulley system may comprise a separate weight source. Alternatively, resistance provided in the further exercise apparatus may be elastic or magnetic resistance. One or more gear wheel and a chain may be used to allow force transfer between a pair of levers or other actuators of the further exercise apparatus.

Figure 2:
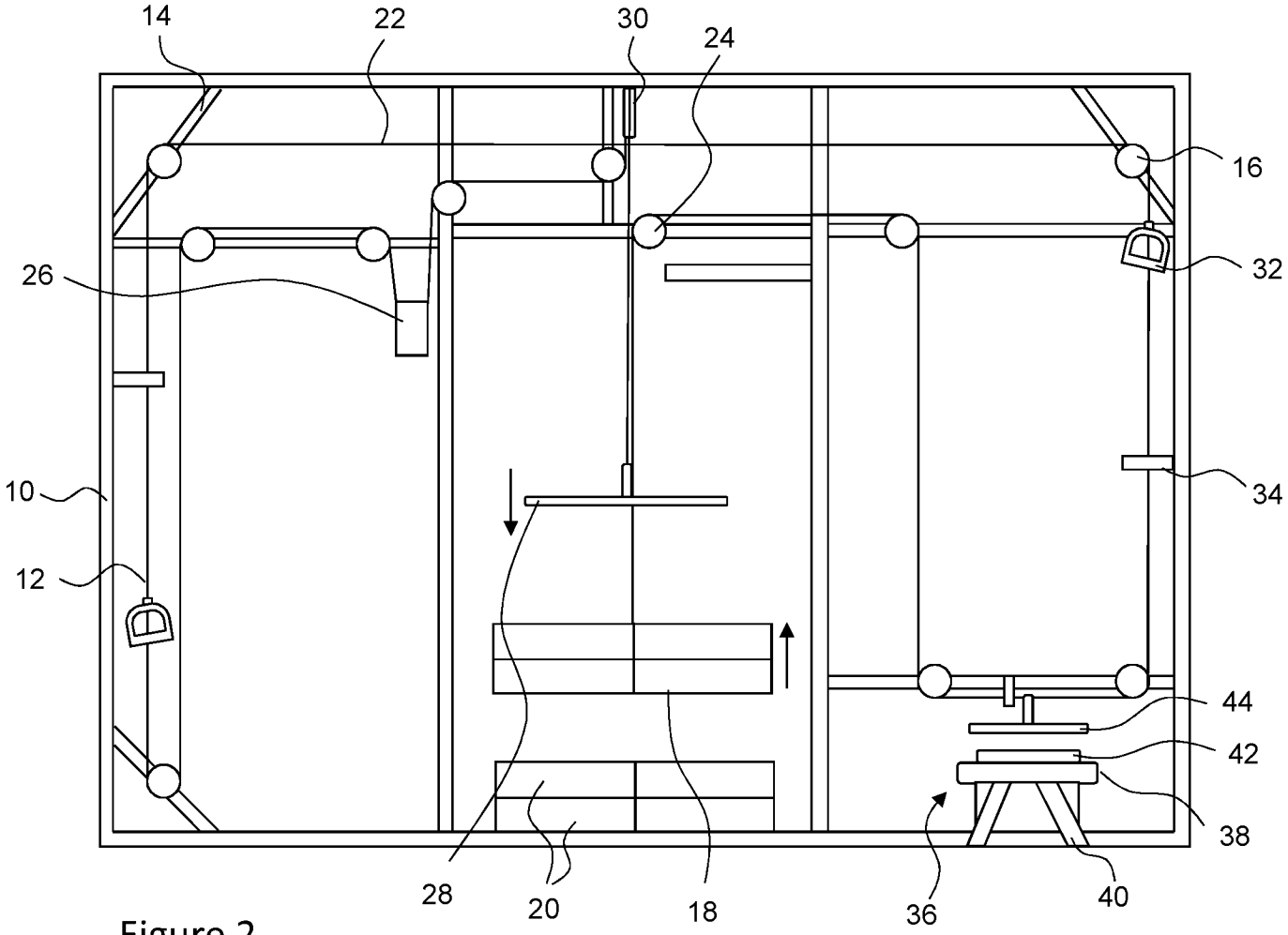
Figure 3:
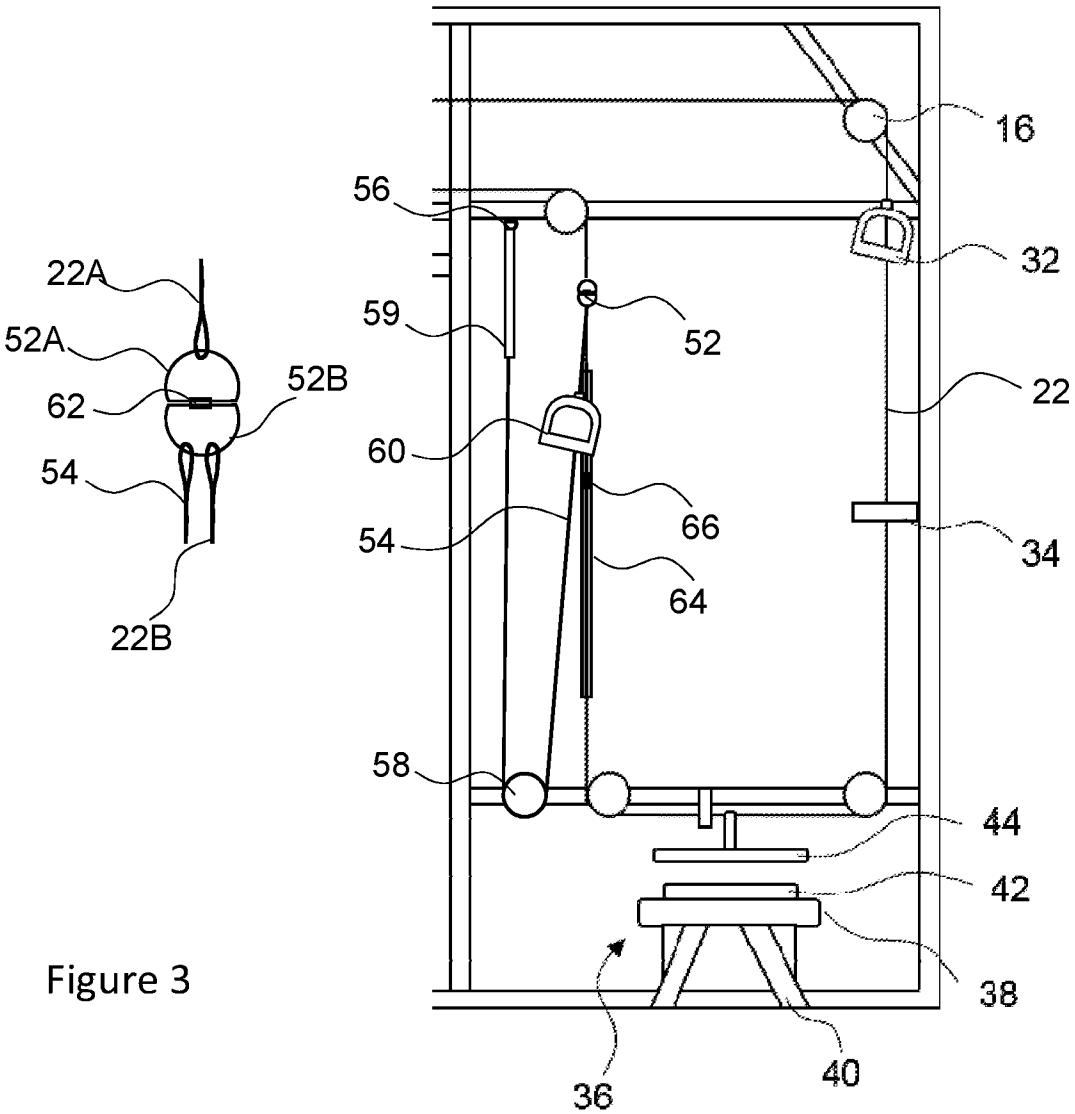

An embodiment of the invention will be described in further detail below, by way of example only, with reference to the accompanying drawings of which:

FIG. 1 is a front view of the apparatus in a first configuration according to an example of the invention; and FIG. 2 is a front view of the apparatus in a second configuration according to an example of the invention; and FIG. 3 shows a front view of a portion of exercise equipment according to an example of the invention, including further constructional detail.

As shown in FIGS. 1 and 2, the exercise equipment comprises a frame 10 and a pulley system 12. The frame comprises a series of frame members or bars 14 which are arranged in the same plane and provide a fixed structure of the exercise equipment. The bars 14 provide support for the frame and also provide a location to which pulley wheels 16 may be attached. In the first configuration, as shown in FIG. 1, the exercise equipment is in its storage arrangement; in the second configuration, as shown in FIG. 2, the exercise equipment is in an arrangement suitable for use.

In FIG. 1 all the pulleys are mounted in a common plane to the frame 10 at least in a storage condition, although one or more pulley may be actuatable away from said plane for use as will be described hereinbelow.

The frame is generally rectangular in plan, comprising uprights 14*a* and cross members 14*b* extending there-between. In this example one or more intermediate frame members span the uprights and/or cross bars to provide additional support and a mounting location for one or more pulley wheel. The intermediate frame members may comprise uprights 14*c*, cross members. 14*d* and/or oblique members 14*e* as necessary and may extend the full distance between opposing/adjacent outer frame members 14*a*, 14*b* or part-way there-between, e.g. being affixed to one or more further intermediate member.

The exercise equipment comprises a weight source 18 which is made up of a stack of individual weights 20, i.e. a so-called weight stack. The weight stack 18 may be conventional in form having a central opening, through which a selector member extends. The required weight to provide a desired resistance for a particular exercise may be selected by the user in a conventional manner by inserting a pin at the desired location in the selector member so as to include/exclude the desired number of weights from the weight stack in the force path connected to the cable. Such an arrangement is known in the art and will not be described or shown in detail for brevity.

However the weights 20 are bespoke to the present design, being of reduced depth dimension, the depth of the weights being sufficiently small that they do not protrude at all or to any significant extent beyond the depth of the frame 10. The depth of the weights and weight stack as a whole from front to back is preferably less than 150 mm or 120 mm and ideally of 100 mm or lower depth.

The weight stack 18 is generally centrally aligned within the frame, e.g. to allow positioning of exercise equipment on either side thereof, although this is not essential.

Preferably the weight stack 18 is within the perimeter of the frame. The weight stack may be constrained between frame uprights or intermediate frame members 14*c*.

A cable 22 forms a circuit around the various pulley wheels that is entirely contained within the frame perimeter.

The cable 22 is attached to the weight stack 18 and extends vertically upwards towards a first pulley wheel 24 which is fixed to a bar 14*d* of the frame 10. The cable 22 extends around the first pulley wheel towards a second and subsequent pulley wheels 16 that are fixed to the frame in different locations, typically all within a common plane. A path for the cable 22 is thereby provided in the common plane of the frame 10 and the majority or all of the cable length is held within the plane when at rest.

The arrangement of pulley wheels 16 on the frame 10, and therefore the layout of the cable path, may vary in different embodiments of the invention, i.e. to allow for different exercises or combinations of exercises. However each different exercise orientation will typically require at least one pulley. A multi-gym arrangement of the type shown will thus comprise four, five, six, or more pulley wheels and typically ten or more pulley wheels.

A counter weight 26 may be provided at one or more location on the pulley system, in order to ensure that sufficient tension is maintained in the cable 22. The counter weight may be suspended from the cable by a pulley wheel (e.g. such that its position along the cable is adjustable) or may be suspended between two pulleys in the system. Maintaining sufficient tension in the cable may help to prevent any twisting or looping in the cable and to prevent the cable becoming accidentally hooked onto parts of the equipment or dislodged from the pulley wheels. As an alternative to a counter weight, a spring or other elastic member could be used to maintain tension in the cable 22. For example, a sprung loaded arm could carry a pulley wheel to deflect the path of the cable at rest. Tension in the cable 22 applied by a user may act against the spring load in use such, i.e. such that upon release of the user-applied tension, the spring will return the cable path to its at-rest, deflected path. This may act in a manner similar to a counter weight 26 without requiring a hanging mass.

At the end of the cable 22 there is provided a hand-held pull bar 28, or T-bar, which may hang down from a final pulley wheel 30 in the system and may be pulled generally downwards by a user during exercise. As the pull-bar 28 is pulled vertically downwards, the cable 22 moves around the path in a first direction and the weight stack 18 is lifted. As the pull-bar 28 is released, moving vertically upwards, the cable 22 moves around the path in a second direction, opposite to the first direction, and the weight stack 18 is moved downwards towards its original position.

The pulley wheel 30, which is at a position in the force path of the cable 22 closest to the hand-held pull-bar 28, is selectively repositionable, i.e. hinged/rotatable in this example. The pulley wheel 30 may be mounted to a suitable hinged bracket or similar which may be selectively locked at the desired orientation for use.

As shown in FIG. 2, the pulley wheel 30 may be rotated such it is out of plane of the frame 10, thereby allowing the cable 22 to extend outwards of the plane of the frame 10 such that the pull-bar 28 is off-set from the plane of the frame 10 and weight stack 18 in use. This allows a user to sit or stand in front of the exercise equipment and pull down the hand-held bar 28 from above, thereby lifting the weights, as indicated by the arrows in FIG. 2.

In other examples of the invention, the end of the cable 22 and an associated manual actuator could be oppositely oriented, e.g. such that it is required to be raised rather than lowered in use to raise the weight stack 18. This could be used for example to allow an exercise akin to a bench press, arm or leg curls, or similar.

Manual actuators 32 may also be attached to the pulley system 12 at various locations in the system, i.e. part-way along the length of the cable 22. The actuators 32 are connected to the cable 22 using suitable connectors.

Cable guides 34 are provided on the frame 10 of the equipment at locations according to the positions of the manual actuators 32 and/or pulley wheels 16. The guides 32 serve to constrain the motion of the cable 22 where necessary according to the exercise to be performed, e.g. to prevent unwanted portions of the cable being pulled away from the plane of the frame during exercise. This helps ensure that cable tension is transferred to the weight stack 18, rather than just resulting in bowing of the cable, and also ensures the cable is correctly aligned to run smoothly over the pulley wheels.

The guides 34 may be looped around the cable 22 in use and may take the form of hooks or eye formations, preferably having a smooth and/or curved contact surface over which the cable can run in use. This is important as the guides may provide a point of deflection of the cable during actuation by a user. The guides 34 can thus provide a location around which the cable 22 may be pulled, in order that the user may carry out a desired exercise by pulling the actuator 32 from a desired location.

The manual actuators may be releasably connectable to the cable, in order that a user may change the position of the actuators on the cable. Similarly, the position relative to the frame at which the guides/hooks 34 may constrain the cable may be variable. The guides 34 may clamp onto the frame at desired locations or else may attach to the frame using suitable fasteners, e.g. releasable fasteners, such as bolts, latches or slot and groove formations.

An actuator that is connected to the pulley system and is not in use for a particular exercise may act as a counterweight for the system, thereby ensuring the cable maintains a required tension. The actuators may therefore be made of a substantially dense/heavy material that they may act as a counterweight.

The exercise equipment comprises a rowing machine 36. The rowing machine comprises a bench 38 with feet 40 and a sliding seat 42 (see FIG. 2) that may slide along the bench 38, e.g. along a runner. When the exercise equipment is in a storage configuration, the rowing machine 36, e.g. the bench 38 and/or feet 40, may be folded upright such that it is stored flat within the frame. In use, the rowing machine 36 may be folded out such that the feet 40 engage with the floor, and a user may sit on the sliding seat 42, facing the frame 10 of the equipment. The feet 40 may be hingedly mounted to the bench or runner and may fold down, e.g. may swing down under their own weight, as the bench 38 is lowered for use. The feet could be manually actuated and/or locked in position for use as required.

A hand-held pull-bar 44 is attached to the pulley system 12 at a position adjacent the bench 38, in order that a user may pull the pull-bar 44 in a direction perpendicular to the plane of the frame 10, whilst sliding on the seat 42 along the bench 38.

As with the pull bar 28, the pull bar 44 is connected to the cable and thus defines a force path to the weight stack 18 such that it can be used to raise the weights 20 in use.

Since the pull bar 44 and actuators 32 are part-way along the cable 22, rather than being at its free end. A stop member 46, shown in FIG. 1, may be used to resist retraction of the free end of the cable 22 beyond a predetermined position. The stop member 46 may depend from the frame and may abut the actuator 28 when fully retracted. Thus the tension applied by the user via the intermediate actuators will transfer to a raising force on the weight stack rather than further retraction of the cable end. In other examples, the stop member 46 may comprise a guide member or a clamp.

Whilst the examples of FIGS. 1 and 2 show only a few types of actuator, the cable may be coupled with a variety of different actuators, including for example a lever or a pair of levers, which may be permanently or selectively coupled to the cable at a suitable point along its length. Thus the system may accommodate a wide variety of reciprocating actuators to cause raising and lowering of the weight stack 18. Such actuators could include a bench press, treadle, or cross trainer, in addition to or instead of the linear actuators shown in FIGS. 1 and 2.

Whilst the end actuator 28 in the examples of FIGS. 1 and 2 has a bespoke pulley wheel 30 that can be repositioned/reoriented between a flat storage condition and an in-use condition, it will be appreciated that such a feature could be applied to any actuator and/or pulley in the system as required. Any such pulley could be mounted on a frame member that can hinge or swing out of the common plane of the remainder of the frame 10 into position for a suitable exercise to be performed.

Furthermore, whilst the cable 22 starts at the weight stack 18 and terminates at its free end at the pull bar 28, in other examples, the cable 22 could terminate at a lower location, e.g. for a lat curl bar or other exercise. Alternatively, the cable could terminate at a connection with the frame.

Other than the option of a repositionable pulley wheel and/or corresponding frame member, the frame is of a generally rigid construction so as to maintain its planar form. Thus the frame is not self-supporting in use and instead requires attachment to a suitable support structure. For this purpose, the frame 10 comprises fixing formations 48 mounted to the frame such that the frame can be attached to a suitable support using bolts or other conventional fasteners. In this example the frame is bolted to a wall such that the common plane of the frame is parallel with that of the wall. In this arrangement, the equipment lies flush against a wall and takes up minimal internal room space.

The frame may be attached to a wall at its four corners or at any suitable locations on the frame structure, typically at multiple locations about the perimeter of the frame and/or intermediate frame members. In some examples, the frame 10 may be located within a recess in a wall, such as an alcove or else by removal of a section of an interior wall leaf, such that frame becomes embedded in the wall and does not protrude beyond the wall surface.

In other examples of the invention, it may be desirable not to attach the frame 10 to a wall. In such examples a base could be used to secure the upright orientation of the frame 10. A suitable base may comprise one or more legs, typically at least two legs, extending forwardly, e.g. perpendicularly of the plane of the frame 10 along the floor. The legs thus prevent toppling of the frame 10 in use. Thus the frame may lie parallel with a wall of a room without requiring attachment to the wall. The frame may lie against the wall or spaced therefrom by a small gap, e.g. with one or more suitable spacer member being provided on the frame. Alternatively, the base construction may allow the frame to be positioned as desired within the interior of a room, without occupying the volume of a 3-D frame structure associated with conventional multi-gyms.

Turning to FIG. 3, there is shown further details of the cable and pulley system features as well as details of cable junctions for connecting manual actuators to the cable 22. The cable 22 described above thus comprises a main or common cable length having one or more connectors 52 defining junctions at which one or more branching cable section 54 can be connected.

The branching cable section 54 passes round a dedicated pulley 58, i.e. a branching pulley which does not serve as a guide for the main cable section 22.

The branching cable section 54 is connected to the connector 52 at one end and to a suitable location on the frame 10 at its other end, e.g. at a frame fixture 56, such as an eye or other formation at which the cable can terminate. In this example, the branching cable section 54 is connected to the frame via an intermediate elastic material section 59 in order to maintain the desired tension (e.g. to avoid any slack in the branch section 54 in use). In alternative arrangements, the branch section could pass over a pulley and terminate at a hanging weight (i.e. a counterweight), rather than a connection to the frame 10 in order to maintain the desired cable tension.

The manual actuator 60 is connected to the branching cable section 54 instead of the common cable section 22.

Whilst the other manual actuators 28, 32 are not shown as being connected to branch connectors in FIGS. 1 and 2, it will be appreciated that any, any combination or all of the manual actuators could be connected in this manner. This kind of branching connection allows manual actuators to be easily connected to or removed from the main/common cable 22 at various points within the cable circuit. It also allows selective positioning of manual actuators in the circuit at locations that may otherwise be inconvenient due to the locations of the common cable pulleys 16. The branching of the cable may also allow a greater range of movement for an actuator 32 to suit a particular exercise.

One such actuator which is desirable to attach to a branching actuator in this manner is the rowing machine pull bar 44. In such an example, a connector currently used for the attachment of actuator 32 in FIG. 3 may additionally or alternatively be used to attach a branch cable which runs around a branch pulley to the actuator 44. The branch pulley in this example may be angled so as to guide the branch cable out of the common plane of the frame 10, i.e. in a direction out of the page of FIG. 3. In a prototype of the invention, the branch cable has a clip, such as a carabiner clip or similar such that the actuator 44 can be selectively attached to, or removed from, the cable and pulley system. The free end of the branch cable may be attached to the frame or a counter weight in the manner hereinbefore described when the rowing machine is not in use. In other examples, the actuator 44 could remain permanently connected.

According to any aspect of the invention, the cable may comprise a common cable extending from the weight source to an opposing end and a plurality of branching cable sections depending from fixed locations of the common cable, e.g. in a dendritic or tree-like manner.

Further details of the connector 52 are shown enlarged and comprise first 52A and second 52B connector sections, joined at a pivot 62. A first part of the main cable section 22A connects to the first connector section 52A and a second part of the main cable section 22B connects to the second connector section 52B. The respective connector sections may comprise eyelets or other suitable formations for cable attachment. The branch cable 54 may connect to either the first or second connector section 52A or 52B as required. Regardless of whether a branching cable section is connected or not, the freedom to permit swivelling between the first and second connector sections allows relief of twisting forces in the cable caused by tension and movement of the cable over pulleys in use. As an alternative, a simple ring connector or other non-swivelling connector could be used. However the ability to relieve twisting forces in the cable has been found to be particularly beneficial.

Also, regardless of whether a branch cable section is used, FIG. 3 shows a further/alternative type of cable guide 64, an elongate guide, which may be used to maintain a desired orientation of the cable 22 during actuation. The guide 64 in this example extends in the direction of an intermediate length of the cable 22, e.g. between two pulleys in the system. A slider or runner 66 is mounted to the guide 64. The cable is attached to the runner 66 to thereby constrain motion of the intermediate portion of the cable 22 to the direction of the guide 64. This has been found to be particularly useful to ensure smooth, snag-free movement of the cable in use. The guide may be used in either of the embodiments of FIGS. 1 and 2, in conjunction with, or without, one or more branch cable sections and/or connectors 52 as required.

It has been found that the invention is sufficiently thin as to lend itself to mounting within a wall, i.e. between embedded within a surface of a wall structure. The frame and the moving cable and pulley system may be exposed or covered by rigid or flexible sheet material to conceal the system. One or more openings in the sheet material may allow the cord to pass into the internal space of a room so as to allow actuation by a user within the room. A sheet/cover of wood or plasterboard or the like, may be used for more permanent installations. The invention may be well suited to mounting against or within the wall of a garden room, or similar, construction.

It will also be appreciated that the frame and exercise equipment could be mounted on an exterior supporting structure or wall if preferred. If mounted on the exterior surface of a building, the cover may protect the apparatus from the elements.

In other examples of the invention, the rigid frame structure of the invention could be mounted to other planar support structures which may be static or moveable between different modes of operation. For example the frame could be mounted in a generally horizontal condition to the underside of a bed or the like, which could be elevated/raised to an upright configuration in the event that it is desired to use the gym equipment. A lock latch would thus be required to maintain the support structure in an upright configuration when exercising.

In further examples, as described above, the frame could be mounted to a base structure such that a planar/vertical support structure is not required. Thus the frame could be free-standing. The frame in conjunction with the base could be generally L-shaped in plan or else in the form of an inverted T shape. The frame could comprise one or more legs that are pivotable from the main frame structure, or that have a sliding telescopic structure. The legs could press against an opposing wall or skirting board for support.

Thus according to various aspects of the invention, the exercise system is characterised by its reduced depth such that it is not self-supporting and requires fixing to a suitable support structure such as the wall of a building, a base or the like, or requires legs to be fixed to the frame for support.

Other gym equipment could be mounted to the frame, e.g. towards the left hand side of the frame shown in FIGS. 1 and 2, but without connection to the cable 22 if desired. In one example a treadle system, e.g. a stepper, is connected to the lower horizontal frame member in that region, which can pivot between a raised storage condition and a lowered usage condition. In the storage condition, the treadle may be flush with the common plane of the frame 10. Thus the frame may accommodate other exercise equipment that does not require connection to the cable circuit described herein.

What is claimed:

1. An exercise apparatus comprising:

a weight source operably connected to a plurality of manual actuators by a cable and pulley system comprising a plurality of pulley wheels and a cable circuit defining a force path from the weight source over the pulley wheels, and a supporting frame for said cable and pulley system, said supporting frame comprising a plurality frame members all extending in a direction within a common plane so as to define a two-dimensional frame structure, the supporting frame comprising a plurality of fasteners for mounting of the supporting frame against a wall of a building such that the supporting frame is supported in an upright orientation with the common plane being parallel with the wall and the supporting frame comprising the weight source and pulley wheels has a depth dimension of less than 200 mm and wherein the cable and pulley system is provided in the common plane with the weight source when the cable and pulley system is at rest, and the manual actuators are provided at spaced locations along the force path defined by the cable circuit and are actuatable in a direction away from the common plane and the wall when in use, and wherein the cable circuit comprises a plurality of cable portions comprising a common cable circuit operably connected to the weight source and one or more branching cable portion indirectly connected to the weight source via the common cable circuit, at least one of the plurality of manual actuators being connected to the branching cable portion.

2. The exercise apparatus according to claim 1, wherein the frame comprises a plurality of upright members and cross members all extending in a direction within the common plane.

3. The exercise apparatus according to claim 1, wherein the exercise apparatus including the frame, weight source and cable and pulley system has a depth dimension of less than 150 mm.

4. The exercise apparatus according to claim 1, wherein the plurality of fasteners mount the frame to the wall such that the frame lies flat against the wall.

5. The exercise apparatus according to claim 1, wherein the plurality of fasteners comprise a spacer member on the frame for spacing the frame from the wall by a gap.

6. The exercise apparatus according to claim 1, wherein the weight source comprises a stack of weights aligned with the common plane and having a depth dimension of less than 150 mm.

7. The exercise apparatus according to claim 1, wherein each of the plurality of manual actuators is connected to one of a plurality of the fixed spaced locations along the cable circuit by a connector.

8. The exercise apparatus according to claim 1, comprising a plurality of the branching cable portions, each connected to the common cable circuit at spaced locations along a length of the common cable.

9. The exercise apparatus according to claim 8, wherein the plurality of branching cables comprise first and second branching cables, the first branching cable passing around a first branching pulley wheel and the second branching cable passing around a second branching pulley wheel.

10. The exercise apparatus according to claim 1, wherein one or more manual actuator is attached to a branching cable so as to apply tension to the common cable circuit and thereby operate the weight source via the branching cable and common cable circuit in use.

11. The exercise apparatus according to claim 1, wherein the exercise apparatus comprises a variety of manual actuator types.

12. The exercise apparatus according to claim 1, wherein the manual actuators are releasably connectable to a plurality of connection formations along the length of the cable circuit.

13. The exercise apparatus according to claim 1, wherein the cable circuit comprises one or more swivel connectors along its length to relieve cable twist in use.

14. The exercise apparatus according to claim 1, wherein at least one pulley wheel rotates about a first axis that is substantially perpendicular to the common plane and at least one further pulley wheel rotates about an axis that is off-set from the first axis.

15. The exercise apparatus according to claim 1, wherein one or more cable guide is provided on the frame, the cable guide comprising a runner attached to the cable circuit so as to constrain movement of the cable circuit to a longitudinal direction.

16. The exercise apparatus according to claim 1, wherein the exercise equipment comprises a seat that folds out from the frame.

17. The exercise apparatus according to claim 1, wherein the exercise apparatus comprises a cover, such that it is hidden from view when not in use.

18. The exercise apparatus according to claim 1, wherein the exercise apparatus comprises further exercise apparatus that is attached to the frame, but not part of the cable and pulley system, the further exercise apparatus comprising a separate weight or resistance source.

19. The exercise apparatus according to claim 1, wherein the exercise apparatus comprises a single weight source and at least four manual actuators connected to the weight source via the cable circuit.

20. The exercise apparatus according to claim 1, wherein at least one of the plurality of manual actuators is connected to an end of the branching cable portion.

21. The exercise apparatus according to claim 1, wherein a stop member is provided at an end of the common cable circuit and/or branching cable portion to prevent retraction of the cable beyond a predetermined position.

22. The exercise apparatus according to claim 1, wherein one of the plurality of manual actuators comprises a rowing machine pull bar.

* * * * *